United States Patent [19]

Neyraud

[11] Patent Number: 4,945,720

[45] Date of Patent: Aug. 7, 1990

[54] THREAD CABLING MACHINE HAVING AN IMPROVED REGULATOR DEVICE

[75] Inventor: René Neyraud, Saint Cyr au Mont d'Or, France

[73] Assignee: ICBT Lyon, France

[21] Appl. No.: 363,053

[22] Filed: Jun. 7, 1989

[30] Foreign Application Priority Data

Jun. 21, 1988 [FR] France ..... 88 08561

[51] Int. Cl.[5] ..... D01H 7/00; D01H 13/10; D01H 7/90; D02G 3/28

[52] U.S. Cl. ..... 57/58.36; 57/58.3; 57/58.52; 57/58.84; 57/58.86

[58] Field of Search ..... 57/58.3–58.38, 57/58.52, 58.84, 58.8 C

[56] References Cited

U.S. PATENT DOCUMENTS 4,549,393 10/1985 Gabalda ..... 57/58.36
4,592,195 6/1986 Charbonnier ..... 57/58.36

FOREIGN PATENT DOCUMENTS 0165188 8/1986 European Pat. Off. .
1175229 3/1959 France .
1202572 1/1960 France .
2565261 12/1985 France .
1197075 7/1970 United Kingdom .

*Primary Examiner*—John Petrakes
*Attorney, Agent, or Firm*—Arnold, White & Durkee

[57] ABSTRACT

A thread cabling machine is provided with an improved regulator device (or cabling head) in which each work station consists of a DT unit similar to a double-twist unwinding spindle which enables two elementary threads to be united by twisting. One of the threads forms a balloon which surrounds the bowl inside which the spool of the second thread is disposed. The two threads are joined on a cabling head consisting of a unit comprising two pulleys mounted on a support driven rotationally by the balloon of the thread. The invention is characterized in that the eye carrier plate, disposed under the rotary pulleys and enabling the threads to be brought to the pulleys, is provided with a frustoconical part enabling the thread forming the external balloon to wind around a reserve groove forming a radius "r" relative to the axis X—X of the unit.

2 Claims, 2 Drawing Sheets

THREAD CABLING MACHINE HAVING AN IMPROVED REGULATOR DEVICE

BACKGROUND OF THE INVENTION

1. Field of the Invention

The present invention relates to an improvement made to machines capable of producing cabled yarns, textile elements of great length obtained by twisting together at least two elementary threads.

It concerns, more particularly, an improvement made to machines of the type described in French Patent Application No. 84 08 975 (Publication No. 2 565 261).

2. Related Art Statement

In general, and as can be seen from the accompanying FIG. 1 which is a reproduction of the FIG. 1 illustrating the abovementioned patent, a cabling machine consists of a plurality of identical work stations disposed side by side, each station comprising a unit similar to a double-twist unwinding spindle (DT unit) which enables the two elementary threads (1, 2) to be united by twisting. The thread (1) taken from a feed source (not shown) arrives at the bottom end of the hollow spindle (3) of the DT unit and passes through a radial channel pierced in a rotating plate (3*a*) on said spindle. Because of the rotation of the spindle the thread is subjected to a false twist and forms a balloon (1*a*) which surrounds the bowl (3*b*) of the spindle (3) of the DT unit. A spool (4) of the second thread (2) is disposed inside the bowl (3*a*). This second thread (2) passes through a braking device (6) carried on the lid (3*c*) of the bowl (3*b*). The threads (1) and (2) are united by twisting by means of a unit given the general reference (7) and commonly called a "cabling head" or "regulator". The invention relates more particularly to this unit and will be seen in greater detail in the remainder of the description. After the two threads have been joined together by twisting at the outlet of the cabling head (7), the cabled yarn (8) formed passes onto a device (9) preventing the twist from rising and then, optionally, after passing around a direction-change guide (10), it is wound in a conventional system given the general reference (11).

As previously stated, the invention relates more particularly to an improvement made to the cabling head or regulator (7) contained in an installation of this kind.

Generally speaking, cabling heads (7) of this kind have up to the present time consisted essentially of a rotating unit mounted in a top bearing (12) in line with the spindle axis. This rotating unit comprises essentially two pulleys (13, 14) disposed on the same axis transverse to the axis of the spindle (3) and angularly fixed relative to one another. The threads (1, 2) wind around these pulleys (13, 14) and are then united at the actual cabling point (15), thereupon passing into an axial channel in the rotating unit (7) for delivery to the system (9) preventing the twist from rising. Rotating-pulley cabling heads of this kind have been known for a very long time, and are described in particular in French Patent No. 1 208 273. It is well known that the rotational driving of the cabling head can be derived either from the outer thread (1) forming the balloon (1*a*), or optionally from an individual motor permitting perfect synchronism.

In cases where the rotational driving of the cabling head is derived from the ballooning thread (1*a*), one of the problems that arise is starting from the working position, because in this phase of the operation, it is necessary that the tension of the balloon (1*a*) is sufficient to provide a driving torque capable of overcoming the resisting torque of the regulator (or cabling head) due to inertia and residual friction. In the opposite case, the regulator will, in fact, immediately lag behind, thus giving rise to a reduction of the driving torque, which may even be eliminated when the lag reaches 180° C., thus immediately causing a break.

SUMMARY OF THE INVENTION

The invention makes it possible to solve this problem by a simple adaptation of the regulator or cabling head, this adaptation consists of adding to the eye carrier plate of the regulator, disposed under the guide pulleys, a frustoconical part enabling the thread (1), forming the outer balloon (1*a*), to wind around a reserve groove forming a radius r relative to the axis of the regulator. With a construction of this kind, whatever the angle of lag of the regulator, the thread can provide the driving torque since the reserve radius r is never eliminated.

The invention and the advantages which it provides will however be better understood from the example of embodiments given below by way of indication, but without limitation, and illustrated in the accompanying diagrammatical drawings, in which:

FIG. 1, as previously stated, illustrates a cabling machine unit comprising a cabling head (or regulator) of the pulley type, in which the rotational drive is derived from the balloon formed by one of the two threads which form the cabled yarn.

FIG. 2 shows, in section, a detail of a cabling head (or regulator) constructed in accordance with the invention, and FIG. 3 is a schematic top view, in section on line III—III, illustrating the manner in which the two threads are brought to the pulleys of a cabling head according to the invention in order to obtain a driving torque upon starting.

DESCRIPTION OF THE PREFERRED EMBODIMENTS

Figure 1:
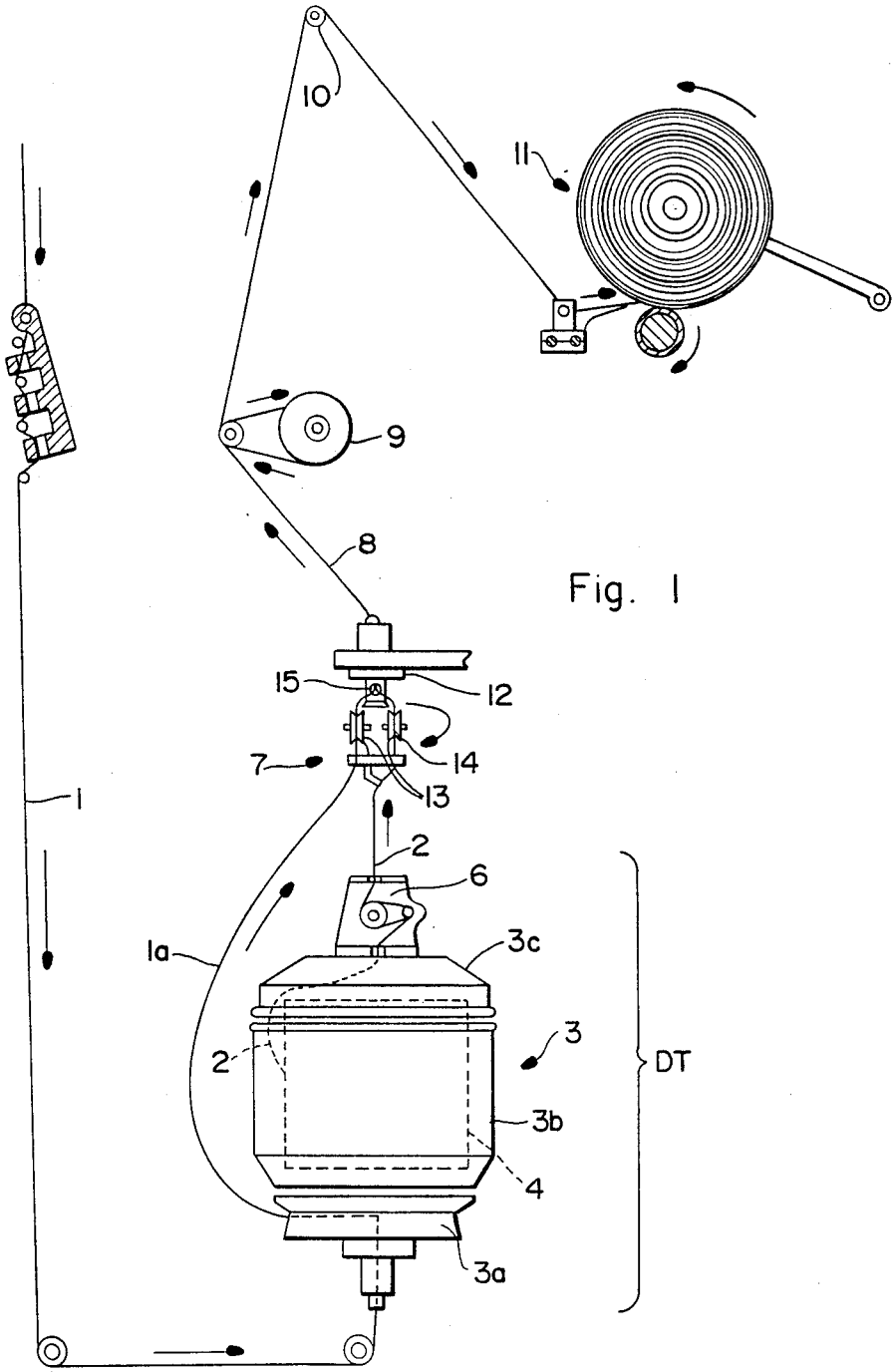
Figure 2:
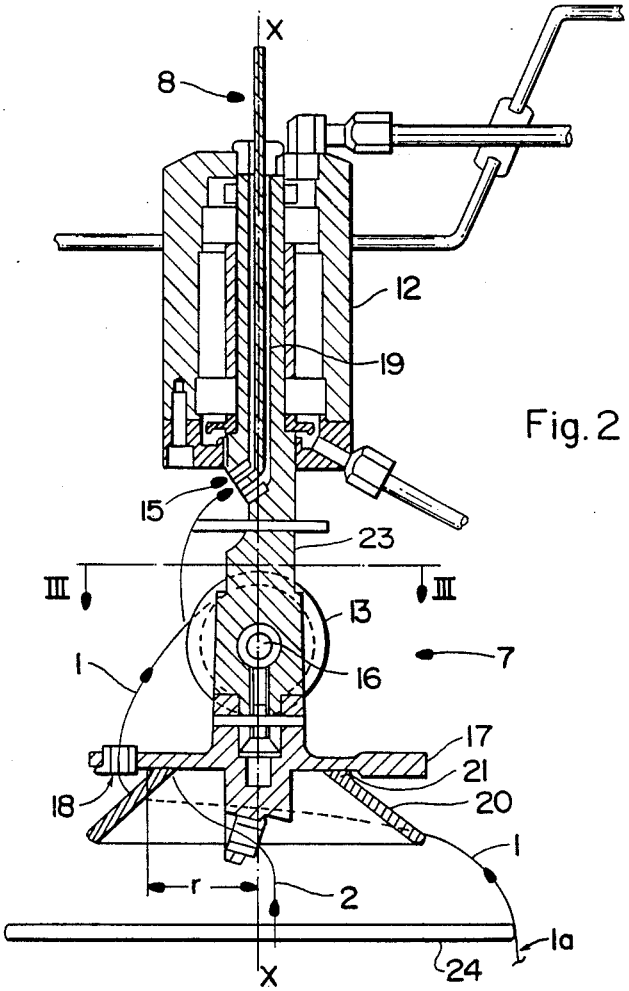
Figure 3:
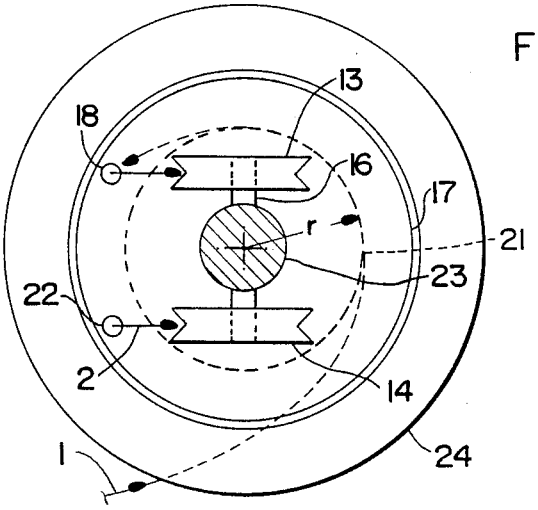

As previously stated, the invention relates to an improvement made to cabling heads (or regulators) used in machines of the type illustrated in FIG. 1, the general construction of which has been described in detail above and will not be further described at this point in the description. According to the invention, and as can be seen in FIG. 2, the cabling head of the invention, given the general reference (7), comprises a rotating unit mounted in a bearing (12) fixed to the frame of the machine. This unit comprises two pulleys (13, 14), of which only the pulley (13) is visible in FIG. 2. These pulleys (13, 14) are mounted onto the same axis (16) transverse to the axis X X of the spindle (3) and angularly fixed in relation to one another. The two elementary threads (1, 2) are brought around each of the pulleys (13, 14) by passing through a plate (17) provided with guide eyes (18, 22) for each of the threads. In FIG. 2 only the guide eye (18) for the thread (1) is shown. The respective positions of the two guide eyes (18) and (22) for the threads (1) and (2), respectively, can clearly be seen in the top view (FIG. 3).

Upon leaving the two pulleys (13, 14), the elementary threads (1, 2) are brought together at the actual cabling point (15) in the form of an eye leading into the longitudinal channel, (19) provided inside the support body (23) for the pulleys (13, 14).

According to the invention a frustoconical part (20) is disposed under the eye carrier plate (17) to enable the thread (1) to wind around a reserve groove (21) having the radius r. With the aid of a frustoconical part of this kind, all risk of reduction of the driving torque upon starting is eliminated, whatever lag may be assumed by the regulator during this operating phase. In order to facilitate the positioning of the thread at the bottom of the reserve groove (21) during starting, an additional circular guide member (24), for example in the form of a disk, is preferably disposed beneath the frustoconical part (20). This circular member is, for example, fixed on the body of the brake device (6).

The invention is obviously not limited to the example of embodiments described above, but covers all variants thereof which are constructed in the same spirit.

I claim:

1. A thread cabling machine provided with a plurality of work stations, each of said work stations comprising a DT unit which provides first and second elementary threads to be united by twisting, wherein a portion of said first thread extends outward from said DT unit so as to surround a bowl of said DT unit inside which a spool of said second thread is disposed, said second thread exiting said bowl substantially along a central axis of said DT unit, said threads being joined on a cabling head comprising:

two pulleys mounted on an axis substantially perpendicular to the central axis of said DT unit, said pulleys being driven rotationally by said first thread;

an eye carrier plate disposed between said DT unit and said pulleys, said threads passing from said DT unit through said eye carrier plate to said pulleys; and a frustoconical member disposed on said eye carrier plate adjacent said DT unit, said frustoconical member and said eye carrier plate collectively forming a reserve groove in which said first thread is wound, said reserve groove being located in a plane substantially perpendicular to the axis of said DT unit.

2. The cabling machine of claim 1, wherein an additional circular guide member in the form of a disk is disposed between the frustoconical member and the DT unit to facilitate positioning of the first thread around the reserve groove upon starting said cabling machine.

* * * * *